United States Patent [19]

Boser et al.

[11] 4,275,673

[45] Jun. 30, 1981

[54] APPARATUS EMPLOYED IN THE ATTACHMENT OF HOOK AND EYE TAPE PORTIONS TO A BRASSIERE

[75] Inventors: Ronald J. Boser, Dix Hills; Henry J. Watts, E. Northport, both of N.Y.; Walter P. Siegel, deceased, late of Lebanon, N.J., by Dorothy Siegel, executrix

[73] Assignee: Union Special Corporation, Chicago, Ill.

[21] Appl. No.: 73,970

[22] Filed: Sep. 10, 1979

[51] Int. Cl.[3] ..... D05B 3/18

[52] U.S. Cl. ..... 112/105

[58] Field of Search ..... 112/104, 105, 113, 114, 112/121.15

[56] References Cited

U.S. PATENT DOCUMENTS

| | | | |
|---|---|---|---|
| 2,573,359 | 10/1951 | Rich | 112/63 |
| 3,399,097 | 8/1968 | Vissage | 156/583 |
| 3,489,537 | 12/1969 | Morin | 112/104 |
| 3,611,959 | 10/1971 | Parlatore | 112/104 |
| 3,716,006 | 2/1973 | Snyder | 112/114 |
| 3,799,086 | 3/1974 | Block | 112/121.15 |

FOREIGN PATENT DOCUMENTS

| | | | |
|---|---|---|---|
| 2,629,117 | 5/1978 | Fed. Rep. of Germany | 112/104 X |

*Primary Examiner*—Ronald Feldbaum

*Attorney, Agent, or Firm*—John A. Schaerli; John W. Harbst

[57] ABSTRACT

An apparatus which aligns, preliminarily clamps, clamps and then sews hook or eye tape portions to a brassiere, in combination with a computer controlled sewing machine.

9 Claims, 11 Drawing Figures

APPARATUS EMPLOYED IN THE ATTACHMENT OF HOOK AND EYE TAPE PORTIONS TO A BRASSIERE

BACKGROUND OF THE INVENTION

The present invention relates to an apparatus and method for positioning and joining fabric sections. More particularly, this invention relates to an apparatus and method for positioning and joining hook and eye tabs to the back strap portions of a brassiere.

Manual methods and apparatuses for the fabrication of brassiere type garments are well known in the art. Additionally, automatic devices for performing the positioning and joining of the hook and eye tape to the back strap portion are known. For example, in one particular method hook tape and eye tape sections are employed which each have a pair of separated end flaps. The desired tape section is secured in a clamp or held by hand and the back strap portion is inserted between the two flaps. The assemblage is then sewn securely together. For the most part, the hook tape, eye tape and back strap portion are of the same width which facilitates the alignment. However, the respective lengths of the hook tape and eye tape vary as does the stitch pattern which is employed therewith in the securement to the back strap portion. Thus, with a prior art automated apparatus for performing the operations hereunder consideration, it may be possible to secure both the hook tape and eye tape portions with the same clamping system, however, difficulty would be experienced in the performance of the sewing operation. That is, the sewing operation in prior art devices has been controlled through the use of a cam assembly. As is apparent, problems are created thereby if the stitch pattern for joining the hook tape is different from that employed in joining the eye portion. For the most part, the prior art combinations even with respect to automated mechanisms suffer from this lack of versatility in that cams must be changed in order to change stitch patterns.

SUMMARY OF THE INVENTION

According to the present invention, a system is provided in combination with a programmed sewing machine which can employ any of a number of programmed devices, for example: core memory, semiconductor or solid state, to name a few. The memory or programmed device contains at least two stitching patterns, the information from which is employed to drive a fabric positioning holder through a predetermined path with respect to the needle of the sewing machine. The location of the hook tape or eye tape member is achieved by the cooperation of horizontally movable positioning levers and a front stop plate, located respectively on either side of an in front of jaw means that are carried by the fabric positioning holder means. At the inception of the cycle, a preliminary clamp is employed to secure the tape and related elements between the horizontally movable positioning levers and the front stop plate. Thereafter, engagement by the jaw means occurs. Upon engagement of the jaw means, the horizontally movable lever means is moved into a non-engaging position and the jaw means are driven through a predetermined work cycle with respect to the needle, to effect the desired stitch pattern.

It is, therefore, an object of this invention to provide an apparatus for positioning and joining the hook and eye tape portions to a brassiere body in combination with, a semiconductor controlled sewing system which is capable of storing a substantial number of different stitch patterns. Yet another object of this invention is to provide a positioning and joining system which is capable of dealing with a hook tape portion in combination with a back strap portion of a brassiere and then the eye tape portion in combination with a back strap portion of a brassiere without the changing of mechanical elements. Yet another object of this invention is to provide a system for the construction of brassieres which is self-compensating to facilitate the width of either a hook tape or an eye tape in combination with a semiconductor control sewing system which has at least two different sewing patterns stored within its memory means. Yet another object of this invention is to provide a method for the joining of hook tape and eye tape portions to the back strap portion of a brassiere.

BRIEF DESCRIPTION OF THE DRAWINGS

The above description, as well as further objects, features and advantages of the present invention, will be more fully appreciated by reference to the following detailed description of a presently preferred, but nevertheless, illustrative embodiment in accordance with the accompanying drawings wherein.

DESCRIPTION OF THE PREFERRED EMBODIMENT

Figure 1:
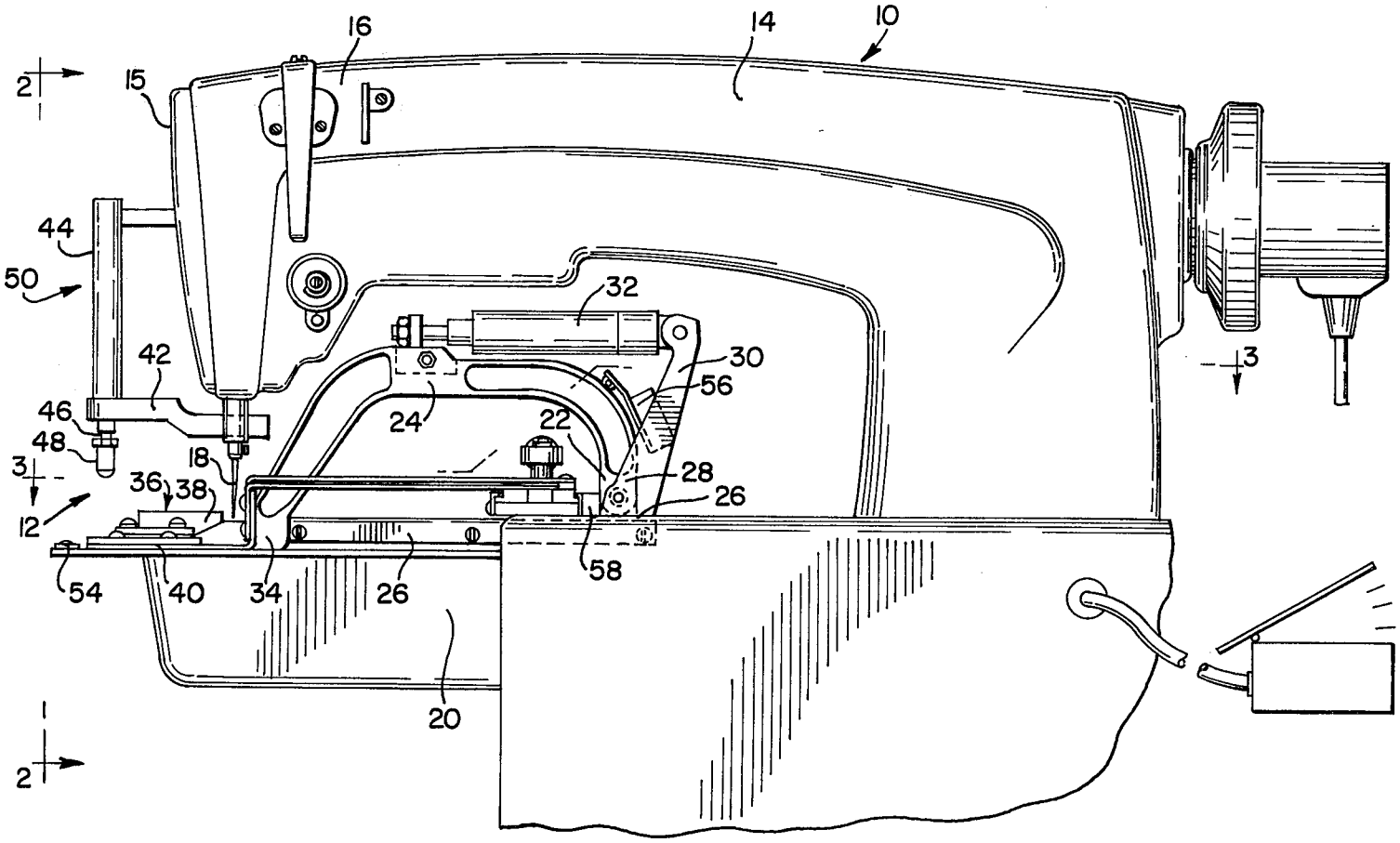
FIG. 1 is a partial side view of the semiconductor controlled positioning and joining system.

Referring now to the drawings and, more particularly, to FIG. 1, there is shown in combination with a programmed sewing machine system 10 the positioning and joining means 12. The programmed sewing system 10 includes a sewing machine 14 having an overhanging arm portion 16 which carries a vertically reciprocating needle means 18. The lower arm portion 20 supports the fabric positioning holder means 22 which, as previously stated, is driven through a predetermined cycle determined by the information stored in the memory of the programmed sewing system. For a complete discussion of the fabric positioning holder means hereunder consideration, reference should be made to U.S. Pat. No. 3,974,787, issued Aug. 17, 1976 to Kraatz et al and U.S. Pat. No. 3,970,016, issued July 20, 1976 to Yanikoski. For a complete discussion of one embodiment of a programmed sewing machine system, reference should be made to U.S. Pat. No. 3,982,491, issued Sept. 28, 1976 to Herzer et al.

Included within fabric positioning holder means 22 is a generally U-shaped elongated lever or channel means 24 that is pivotally carried on the sliding plate means 26 at a first end 28. A support member 30 that is secured to the plate means 26 provides support for cylinder means 32 such that by the reciprocation of the piston thereof force can be exerted on or removed from the U-shaped lever means 24, the U-shaped channel means 24 then pivoting around the end means 28. Carried adjacent a second end means 34 of the elongated lever means 24 is jaw means 36. The jaw means 36 include an upper jaw means 38 and a lower jaw means 40. As is appreciated, the upper jaw 38 is connected to the U-shaped elongated bar means 24 and the lower jaw means 40 is connected to the sliding feed plate means 26. The two jaw means 38 and 40 are additionally pivotally mounted with respect to each other. These jaw means work in combination to securing the work pieces during the work cycle.

Secured to the front section 15 of the upper arm means 16 by a suitable means such as bracket means 42 is a pneumatic cylinder means 44. Attached to the rod portion 46 of the pneumatic cylinder means 44 is a high friction fabric engaging means 48. These elements in combination make up a preliminary clamp means 50 employed to engage the fabric in the initial stages of the work cycle as will hereafter be more fully explained.

Figure 2:
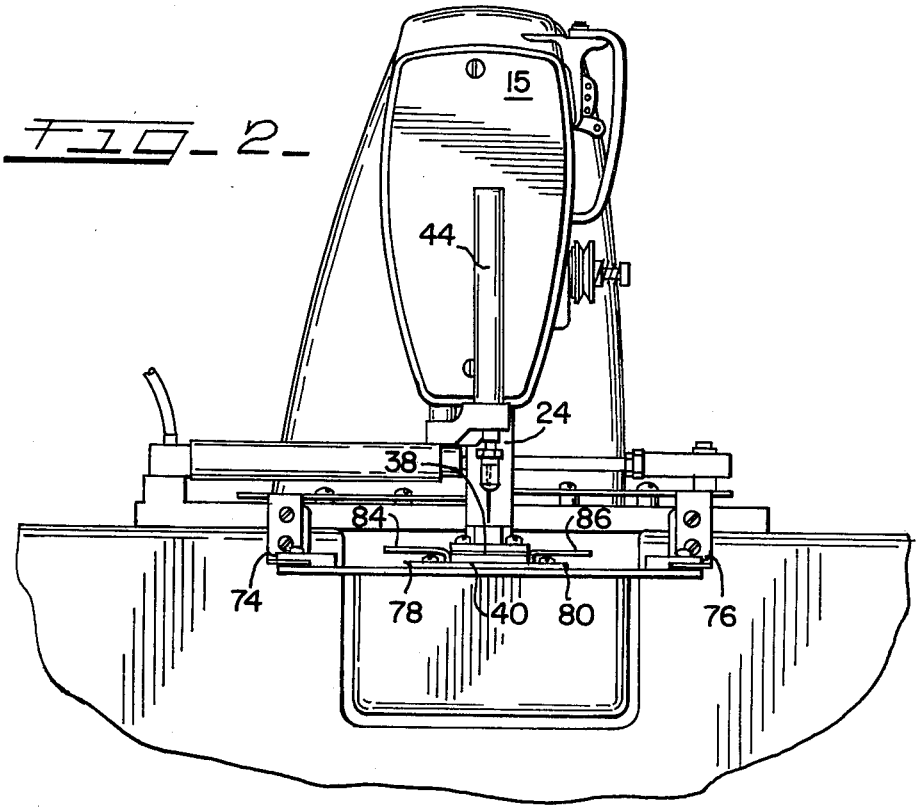
FIG. 2 is a front elevational view of the sewing machine incorporating the present invention.
Figure 4:
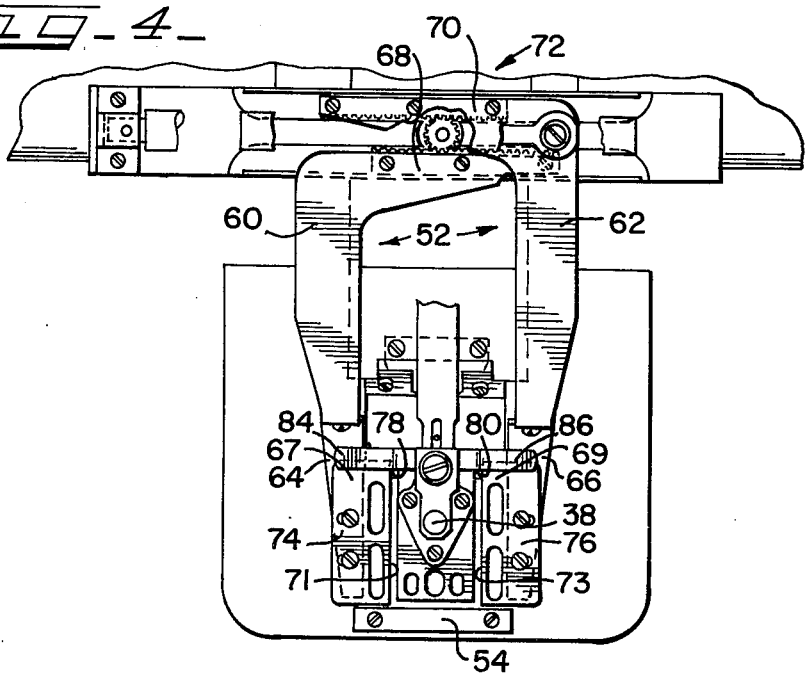
FIG. 4 is a partial broken away view showing the various elements involved in the positioning and joining system.
Figure 3:
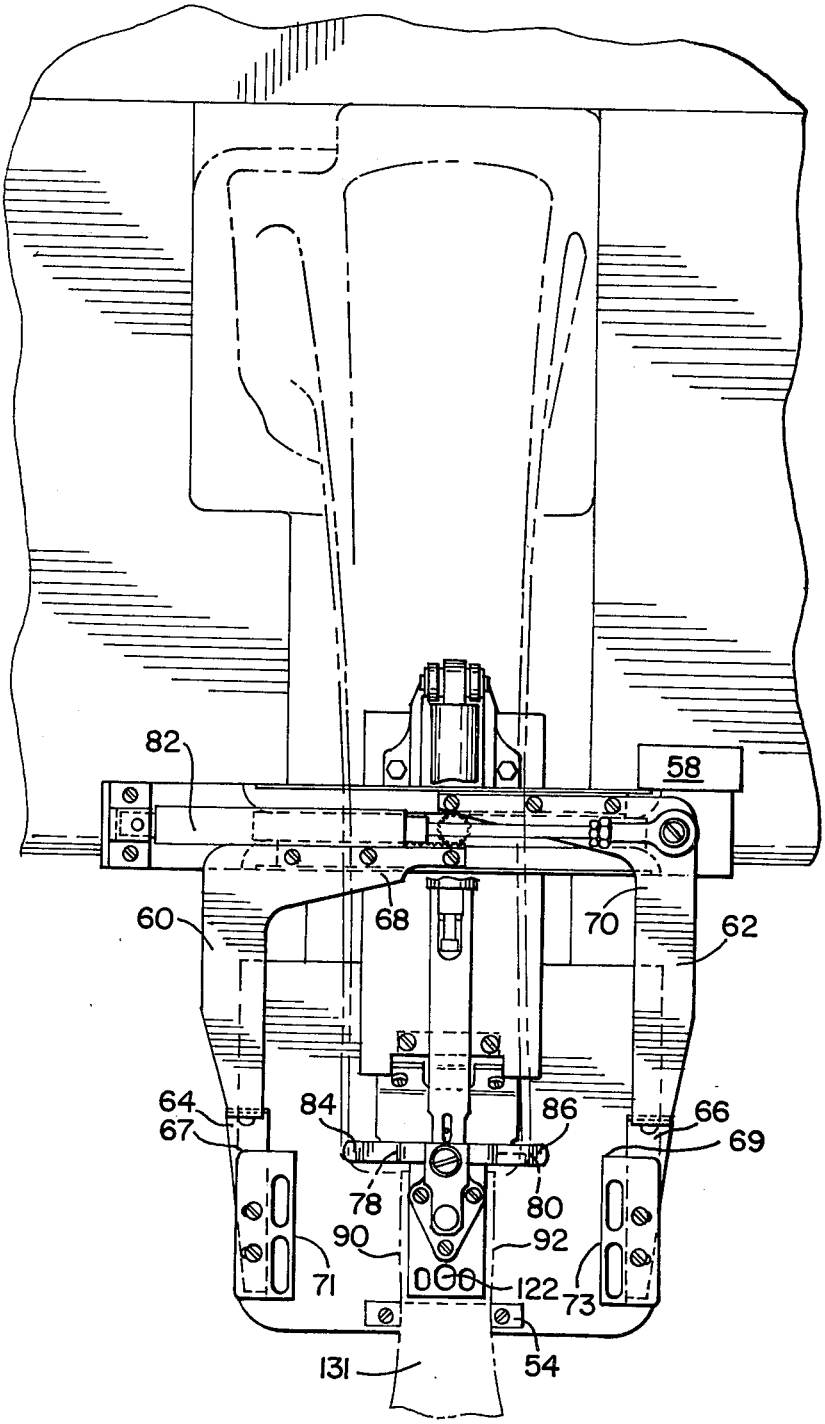
FIG. 3 is a top view of FIG. 1 taken generally along the line 3—3.

Referring now to FIGS. 2 and 3, the joining and securing apparatus for the hook and eye tape sections will be further discussed. Included within the positioning and joining apparatus 12 as previously discussed is the preliminary clamp means 50 and the jaw assembly means 36. These means work in combination with horizontally movable positioning lever means 52, a front stop means or stationary fabric aligning means 54, and first and second microswitch means 56 and 58. The horizontally movable lever means 52 includes a first lever 60 and a second lever 62 each of which has first front ends 64 and 66 and second rear ends 68 and 70. Secured to the rear end 68 and 70 is an actuating device 72 which in the preferred embodiment is a rack and pinion assembly. Upon the actuation thereof the arms can be driven between the positions as shown in FIGS. 3 and 4. Secured to the leading extremities of first front ends 64 and 66 are fabric centering means 74 and 76 (See FIG. 2) which in a preferred embodiment have abutting portions 67 and 69 and fabric contacting means 71 and 73 (See FIG. 3). The rack and pinion means 72 drives the abutting portions into the outer edges 78 and 80 of the lower jaw means 40 as is shown in FIG. 4. In practice, the rack and pinion assembly means 72 is driven by a pneumatic cylinder means for example 82 until this abutting relationship is achieved. Thus, it is apparent that by changing the width of the lower jaw support means different width tapes can be accomodated thereabove. Wings or stabilizing means 84 and 86 are provided in the area of abuttment to further stabilize the engagement.

The point of abutment of the outer edges 78 and 80 and abutting portion 67 and 69 is such that a gap is created between the fabric contacting the fabric engaging means 71 and 73 and the upper jaw means 38. Thus, from a consideration of FIGS. 3 and 4, it is apparent that a given amount of fabric will be exposed around the three sides of the jaw means. In practice, the jaw means 38 and 40 are selected such that they will allow this predetermined amount of fabric to extend out therefrom. The outer edges 78 and 80 are adjustable in a predetermined manner with respect thereto such that the abutting portions 67 and 69 achieve an abutting relationship while at the same time fabric contacting means 71 and 73 just contact the outer edges 90 and 92 of the fabric 131. The result being that the fabric, which comprises the hook tape and related bra portion or eye tape and related bra portion, is centered in a predetermined manner with respect to the upper and lower jaws 38 and 40. In effect, the fabric centering means 74 and 76 function as guide means for centering the fabric means therein with the necessary predetermined amount of fabric extending out therefrom along the three sides of the jaw means. The necessity of having the fabric exnteing out an exact predetermined amount becomes apparent where it is appreciated that it is in these regions that the particular sewing pattern is effected. It must also be appreciated that if for some reason the fabric is not properly aligned a substandard stitch pattern will result and may cause the resultant brassiere to be classified as a second.

Referring now to FIGS. 8–11, wherein are shown representative samples of a hook tape 96, an eye tape 98, each of which has been joined to the back strap portion of a brassiere 100 and **100*a***.

Figure 11:
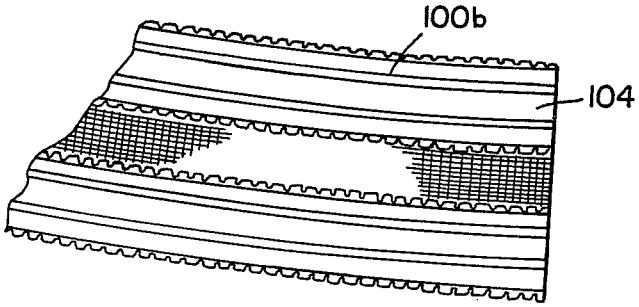
FIGS. 8–11 show various views of the hook and eye tape portions and the back strap portion.
Figure 10:
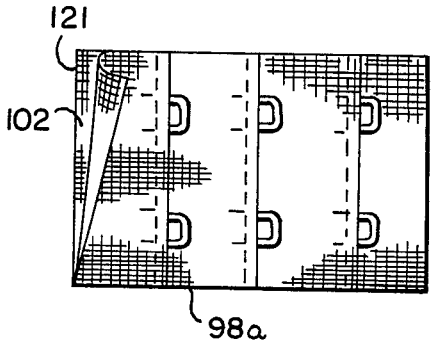

An unsecured eye tape **98*a* and unsecured brassiere portion 100*b* are shown in FIGS. 10 and 11. The unsecured eye tape 98*a* shows the wing or flap portion means 102 which are folded around the leading edge 104** of the brassiere.

Figure 9:
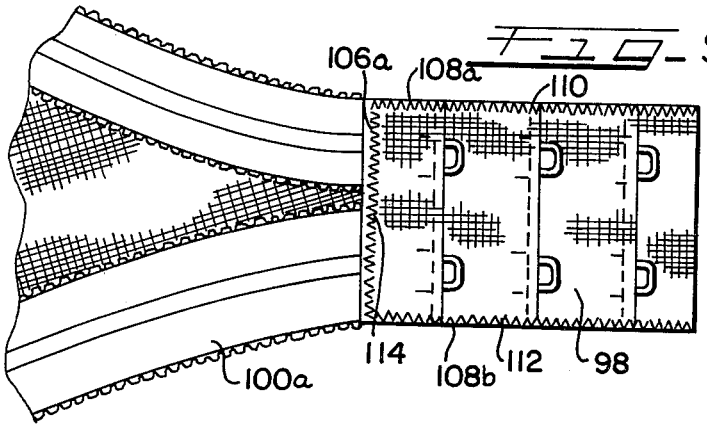
Figure 8:
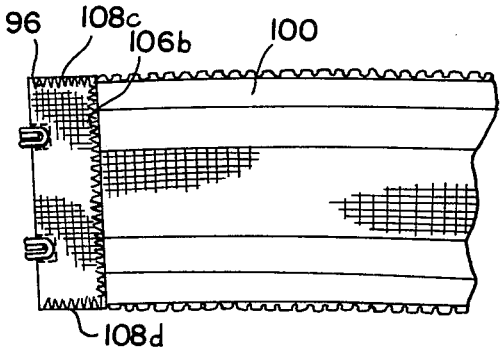

The samples shown in FIGS. 8 and 9 are secured with stitch runs **106*a* and *b* and 108*a–d*. It should be appreciated that the sections 110 and 112, for example, of stitch run 108*a* and *b* are sewn to close the outside open edge of the eye tape 98. Only the upper section 114 actually secures the two fabric portions. As is apparent, the area wherein the stitches are sewn is that which extends out along the three sides of the fabric engaging jaw means 38 and 40. The sections 110 and 112** being most critical in this regard since displacement of the thread into or out of the body of the fabric will result in improper stitch formation. For example, if the fabric is not engaged or just barely engaged, the stitch may not be formed at all.

In operation, the operator manually positions the end 104 of the bra section between the two flap means 102 of the eye portion **98*a*. The same assembly would be repeated of course for the sewing of the hook portion and the same clamp and procedural steps being employed as well. Returning now to the attachment of the eye portion 98*a* to the bra section 104, the operator, once having positioned them correctly with respect to each other, inserts the leading edge 118 between the jaw means 38 and 40. During this point in the cycle, the arm means 60 and 62 have assumed the position shown in FIGS. 4 and 5. Thus, the fabric engaging portion 71 and 73 serve to align the fabric combination such that seams 110 and 112 as shown in FIG. 9 can be placed in the proper location. Once the garment is properly positioned with respect to the fabric contacting means 71 and 73, the operator slides the assemblage in a direction out of the jaws until the leading edge 121 of one of the wings 102 just contacts the leading edge 115 of the front stop plate means 54. When all of these parameters have been achieved it can be said that the garment is properly positioned to begin the sewing cycle. An alternate procedure would be to first locate the eye tape 98*a* properly within the clamp jaws 38 and 40 and front stop 54 and then insert the leading edge 104 of the bra section between the flaps 102**. In either procedure, the same result will be achieved.

Figure 5:
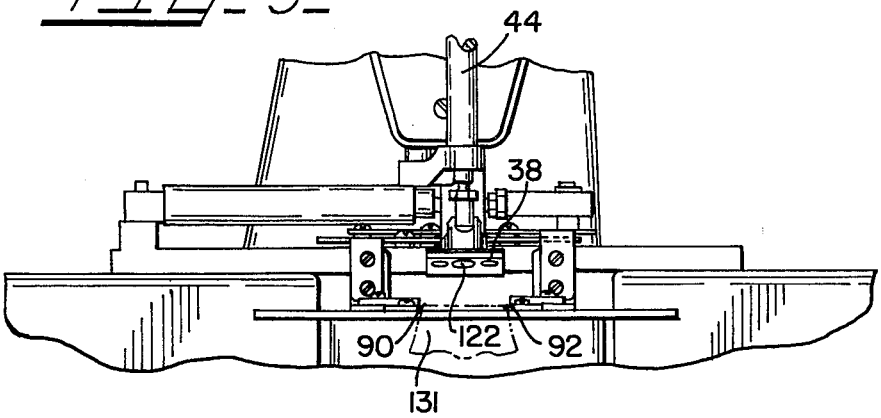
FIGS. 5–7 are views showing the various steps involved in the location of the various mechanical elements as the positioning and joining system moves through a partial work cycle.
Figure 6:
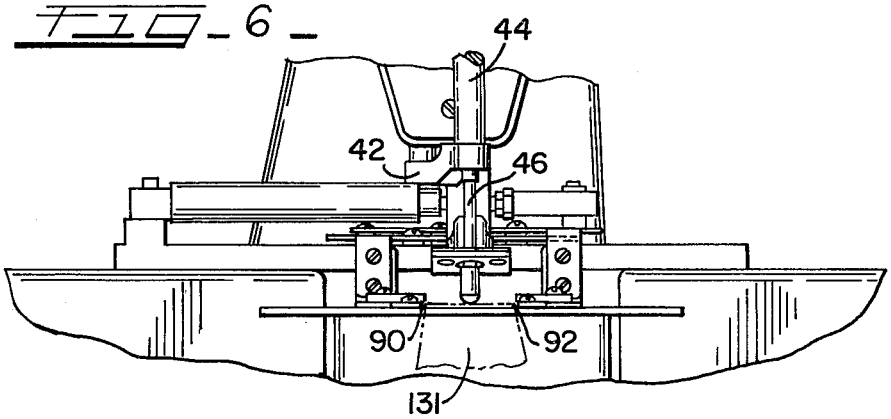
Figure 7:
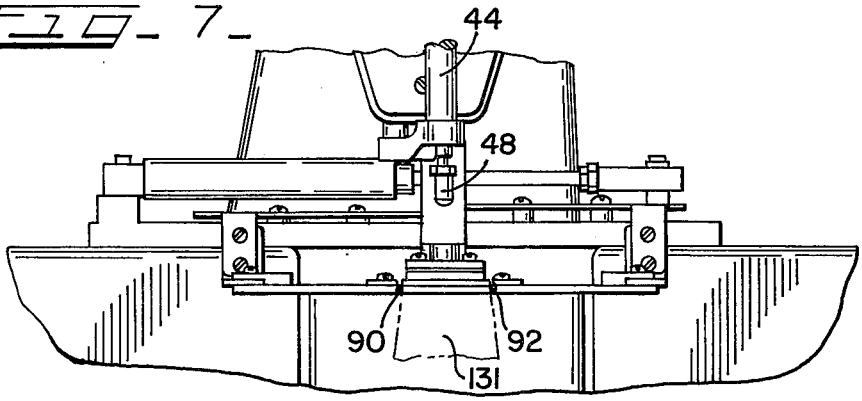

The relationship of the various elements is now substantially that shown in FIG. 5. In order to initiate the automatic cycle, the operator need only actuate a multi-position switch, for example a treadle switch 120, as is well known in the art. Upon the actuation of the treadle switch to a first position, the preliminary clamp 50 moves into the position represented in FIG. 6. That is, the preliminary clamp means 50 is actuated such that the high friction fabric engaging means 48 passes through the aperture 122 in the top jaw 38 to preliminarily secure the fabric elements. The operator then checks all of the fabric elements for proper alignment. If any of the elements are misaligned, the operator returns the foot switch to a neutral position causing the friction fabric engaging portion 48 to return to its original non-fabric engaging position. An operator can then properly realign the fabric elements and again actuate the treadle to the first position as previously described. In the event that all elements are properly aligned, the operator pushes the foot pedal to a second position which triggers or actuates the pneumatic cylinder 32 to clamp the top jaw 38 against the bottom jaw 40. As the elongated U-shaped member 24 moves down into a clamping position a micro-switch 56 (FIG. 1) is actuated. The actuation thereof in turn causes the arm means 60 and 62 to move into the position as shown in FIG. 3 and the preliminary clamp 50 to return to its neutral position as shown for example in FIG. 1. The action of the arm means 60 and 62 is employed to trigger a second micro-switch means 58 at a point just prior to their maximum spread distance. This point coming after the preliminary clamp and, more specifically, the high friction fabric engaging portion 48 has cleared the aperture 122. The actuation of the micro-switch means 58 in turn triggers or initiates the beginning of the predetermined sewing cycle whereby a sewing pattern such as that shown in FIG. 9 is achieved. During the time that this sewing cycle is taking place, the operator can be manually arranging the strap portion of the other end of the same brassiere portion for the attachment thereto of a hook portion such as that shown in FIG. 8.

Upon completion of the sewing cycle, the logic system of the programmable sewing machine actuates the pneumatic cylinder 32 such that the jaws are opened. As is apparent, upon opening of the jaw means 40 and 38, the first micro-switch 56 will be actuated. This actuation in turn causes the arm means 60 and 62 to return to the position shown in FIG. 4 such that the next sewing cycle can be undertaken.

An additional feature of the apparatus and method as has been described relates to the simplicity with which the apparatus can be converted to handle garment elements of different widths. That is, the width as represented by the stitch line 114 in FIG. 9. Depending upon this width, it becomes only necessary to change the upper and lower jaws 38 and 40. Built into each set of jaws is the relationship to determine the amount of material or fabric which will protrude out from around the edges of the jaws. In the example, as has been described, this relationship is determined by the point at which edges 78 and 80 abutt portions 67 and 69. That is, because the arm means 60 and 62 will be driven inwardly until the portions 67 and 69 abut the edges 78 and 80, the pneumatic cylinder 82 is simply being driven through a shorter or a longer stroke. Thus, the overall apparatus can be very easily and simply converted to accomodate the sewing of different width fabric elements.

In summation, an apparatus which is employed in the joining of hook and eye tape to a brassiere. Included in the apparatus are first and second fabric aligning means. In the embodiment described, these are the horizontally movable positioning lower means and the front stop means secured to the throat plate of the sewing machine. The jaws of the fabric positioning holder are in the raised position and the first and second fabric aligning means generally positioned therearound. The first fabric aligning means having moved in to the position in response to a switching signal.

The fabric is inserted between the jaw means and the treadle moved to a predetermined position whereby the preliminary clamp secures the fabric. Actuation of the switch to the next position causes the jaws to shut which in turn trigger a switch that retracks the preliminary clamp and moves the fabric contacting end means of the first aligning means from engagement with the fabric. As the rack and pinion driving assembly moves arms of the first alignments, yet another switch is activated which begins the actual sewing cycle. The jaws being opened at the completion thereof, which causes the first aligning means to be returned to its initial position.

Thus, it is apparent that there has been provided, in accordance with the present invention, an apparatus for use in combination with an automatic sewing machine for attaching hook and eye tape portions to a brassiere that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

Having thus described the invention, what is claimed herein is:

1. An apparatus used in combination with a computer controlled sewing machine for aligning and securing independent fabric elements prior to and during a sewing cycle comprising:

a fabric positioning holder mean having its movement controlled by said computer means, including jaw means for securing fabric means;

horizontally movable positioning lever means having fabric centering means;

means operative for driving said horizontally movable positioning lever means between a series of predetermined positions along with said jaw means;

a stationary fabric aligning means located in a predetermined position with respect to said jaw means; and a preliminary clamp means securing said fabric means within said jaw means and between said horizontally movable positioning lever means prior to the initiation of the work cycle.

2. The apparatus of claim 1 wherein said jaw means include first and second jaw means cooperating in a sandwich like manner, at least one of said jaw means being pivotally mounted.

3. The apparatus for claim 1 wherein said computer controlled sewing machine includes a throat plate means, said stationary fabric aligning means being secured thereto, directly in front of said jaw means.

4. The apparatus of claim 1 including first and second switch means, said first switch means being operatively associated with said fabric positioning holder means and said second switch means being operatively associated with said means operative for driving said horizontally movable positioning lever means.

5. The apparatus of claim 2 wherein said first jaw means is provided with an aperture means located in a predetermined position whereby said preliminary clamp can pass therethrough.

6. The apparatus of claim 5 wherein said preliminary clamp includes a pneumatic cylinder means having a rod means which has a high friction fabric engaging means secured thereto.

7. A method for securely joining at least two fabric elements comprising the steps of:

inserting the fabric elements between a series of jaw means;

positioning the fabric elements with respect to a series of horizontally movable positioning lever means and a stationary aligning means;

actuating a preliminary clamp means for temporarily securing the fabric elements;

actuating a main clamp means for securing the fabric elements and causing the movement of the prelimary clamp and horizontally movable positioning lever means into non-engaging positions; and moving of said horizontally movable positioning lever means actuating a computer controlled sewing system for sewing together said fabric elements.

8. In combination with a computer controlled sewing machine, an apparatus for aligning and securing fabric elements comprising:

first and second aligning means at least one of said means being movable;

a first switching means having at least two positions; preliminary fabric clamping means engaging the fabric means upon movement of said switching means to a first position;

fabric clamping means generally positioned centerally of said first and second aligning means which upon actuation of said switching means to a second position clamps said fabric elements;

a third switch means actuated by said fabric clamping means for causing the disengagement of said preliminary fabric clamping means and at least one of said aligning means; and a fourth switch means for actuating the sewing cycle of said computer controlled sewing machine and being actuated by the disengagement of one of said aligning means.

9. The apparatus of claim 8 wherein:

said first movable aligning means includes first and second horizontally movable positioning lever means each having a first fabric contacting end means and second end means secured to a rack and pinion assembly whereby upon actuation of said rack and pinion assembly said fabric contacting end means move toward or away from each other.

* * * * *